United States Patent [19]

Kippen

[11] 4,006,851

[45] Feb. 8, 1977

[54] NIGHT STICK HOLDER

[75] Inventor: Albert J. Kippen, Springfield, Mass.

[73] Assignee: Bangor Punta Operations, Inc., Greenwich, Conn.

[22] Filed: Feb. 24, 1976

[21] Appl. No.: 660,885

Related U.S. Application Data

[63] Continuation of Ser. No. 109,252, Jan. 25, 1971, abandoned.

[52] U.S. Cl. ..... 224/3; 224/5 R

[51] Int. Cl.[2] ..... F41C 27/00

[58] Field of Search ..... 224/3, 1 R, 1 A, 2 B, 224/2 C, 2 D, 2 E, 2 F, 5 R, 5 A, 5 B, 5 E, 5 J, 5.1, 26 R, 25 R

[56] References Cited

UNITED STATES PATENTS

| | | | |
|---|---|---|---|
| 702,398 | 6/1902 | Bowyer | 224/2 F X |
| 969,524 | 9/1910 | Condon | 224/1 R |
| 2,387,900 | 10/1945 | Hartwell | 224/3 |
| 2,765,968 | 10/1956 | Gaylord | 224/2 B |
| 3,583,612 | 6/1971 | Theodore | 224/2 B |

*Primary Examiner*—Albert J. Makay
*Assistant Examiner*—Jerold M. Forsberg
*Attorney, Agent, or Firm*—Patrick J. Walsh

[57] ABSTRACT

The night stick holder includes a flexible sleeve split substantially lengthwise and having a pair of axially spaced snap fasteners. The night stick has an enlarged diameter portion at the bottom of the handle and the fasteners, when secured, serve to close the sleeve about the tapered body of the night stick, the enlarged diameter portion and the tapered body serving to preclude endwise movement of the stick through the sleeve in either direction. To draw the stick from the holder, the stick is first canted forwardly and the upper fastener unsnapped. The stick may then be jerked downwardly and forwardly in a swinging motion to automatically unsnap the lower fastener whereby the stick is withdrawn through the split sleeve.

10 Claims, 4 Drawing Figures

FIG.1
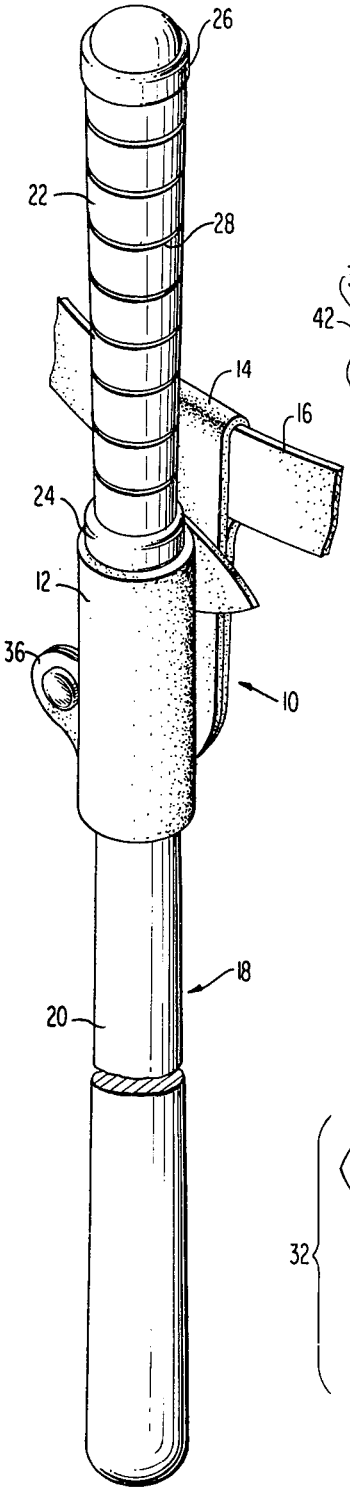
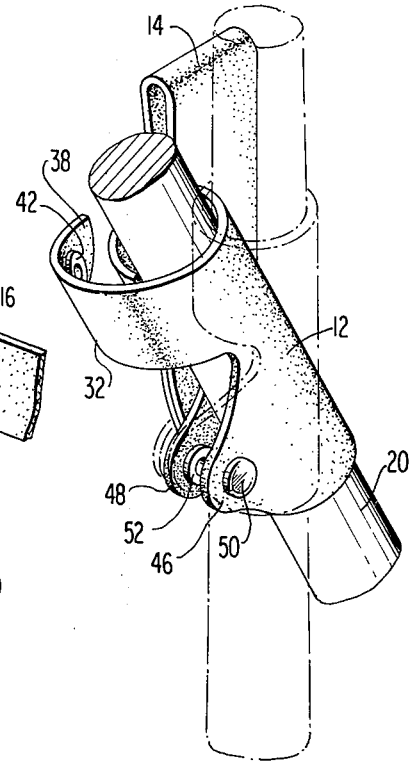
FIG.3
FIG.2
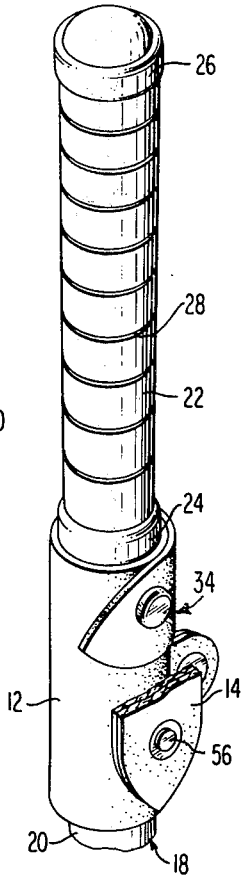
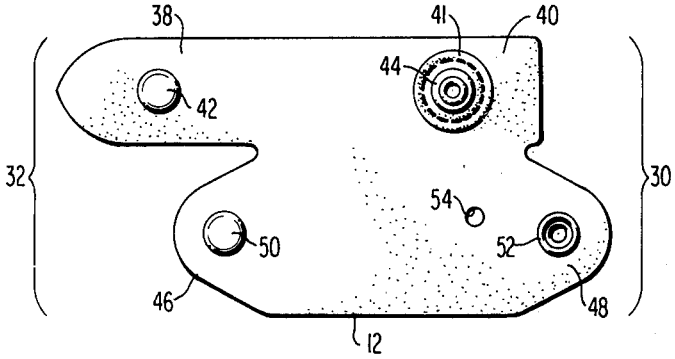
FIG.4
INVENTOR
ALBERT KIPPEN
BY Patrick J. Walsh
ATTORNEY

NIGHT STICK HOLDER

This is a continuation of application Ser. No. 109,252 filed Jan. 25, 1971, now abandoned.

The present invention relates to an improved holder for night sticks, clubs, bludgeons, billy-clubs, and the like, (hereinafter referred to as night sticks), and particularly relates to a holder having a pair of fasteners for securely retaining the night stick in the holder and which fasteners may be readily unsnapped for quickly withdrawal of the stick from the holder.

Night sticks have been used in the past by various law enforcement agencies for a wide range of purposes. One of the very essential requirements of a night stick holder is that the stick, when disposed in the holder, cannot be withdrawn therefrom by someone other than the individual carrying the night stick. That is to say, one of the prime prerequisites of a night stick holder is that the stick cannot be snatched from its holder by an unauthorized individual. Concomitantly, it has been found that a desirable feature of a night stick holder is the ability to permit prompt withdrawal of the night stick from the holder whereby the night stick can be quickly employed for its intended purpose. Thus, a policeman, for example, should be able to withdraw the night stick rapidly from the holder should the need arise. It is also desirable that the individual carrying the night stick, i.e., a policeman, can rapidly withdraw the stick from the holder while simultaneously giving the appearance that the stick is firmly secured in the holder. This is particularly important in circumstances where the policeman does not wish to present a provocative appearance which, in certain instances, only serves to intensify the conflict situation at hand, and yet is able to rapidly withdraw the night stick from its holder should the need arise.

Many holders for various types of hand carried weapons have been provided in the past. For example, quick-draw holsters for sidearms, as well as quick-draw type holders for night sticks, are known. One such holder for a night stick provides a split collar with the opposed legs of the collar being spring biased to permit withdrawal of the night stick laterally outwardly. This type of holder, however, permits not only the individual carrying the night stick to withdraw the same from its holder, but also permits an unauthorized individual to do likewise. Another type of holder for a night stick includes a split collar having a fastener joining the legs of the collar together to retain the night stick in the collar. Again, however, the night stick can be withdrawn upwardly through the collar by an unauthorized individual.

The present invention provides a novel and improved holder for night sticks and the like wherein a night stick can be secured in the holder in a manner wherein it is virtually impossible to unauthorizedly remove it from the holder and also wherein the stick is retained in the holder in a manner permitting its quick withdrawal from the holder by its authorized user. Further, the night stick in the holder gives the appearance that it is firmly secured in the holder, whereas, in reality, it can be brought to the fore virtually instantaneously. To these ends, the present invention provides a holder including a sleeve formed of a flexible material, preferably leather, for receiving and confining the body portion of the night stick. The sleeve is split substantially lengthwise to form opposed edge portions. A pair of axially spaced snap-type fasteners are provided on the sleeve with a part of the upper fastener being carried by a tab overlying the opposed edge portion and lying between the holder and a belt supporting the holder. When the opposed edge portions of the sleeve are closed about the body of the stick between the enlarged flange at the lower end of the stick handle and the tapered body portion of the stick, and the fasteners are snapped together, endwise movement of the night stick through the holder in either direction is precluded as the enlarged flange and enlarged tapered body of the night stick simply cannot pass through the sleeve. The parts of the lower snap fastener are carried by opposed tabs which project outwardly of the sleeve, the inner faces of the tabs facing one another. Thus, when the two snap fasteners are closed, the holder not only firmly secures the night stick but also gives the appearance that the night stick is so firmly secured in the holder that it cannot be readily withdrawn from its secured position. However, to rapidly withdraw the night stick from its holder, the handle is grasped and the stick is canted forwardly providing ready access to the upper fastener which may then be quickly unsnapped by a thumbing action on the upper tab. The stick is then jerked downwardly and forwardly in a single swinging motion which automatically snaps the lower fastener open permitting quick and complete withdrawal of the night stick from the holder.

Accordingly, it is a primary object of the present invention to provide an improved holder for night sticks and the like.

It is another object of the present invention to provide an improved holder for night sticks and the like wherein the night stick is secured in the holder against unauthorized removal and wherein the holder is arranged to permit quick withdrawal of the night stick from the holder.

It is still another object of the present invention to provide a novel and improved holder for night sticks and the like wherein the night stick obtains the appearance of being fully secured in the holder while actually it can be rapidly withdrawn therefrom.

It is a further object of the present invention to provide an improved holder for night sticks and the like having the foregoing characteristics and wherein the holder can be simply and economically manufactured.

These and other objects and advantages of the present invention will become more apparent upon reference to the following specification, appended claims and drawings wherein:

FIG. 1 is a perspective view of a night stick holder constructed in accordance with the principles of the present invention and illustrating the holder with the night stick fully secured therein;

FIG. 2 is a view similar to FIG. 1 illustrating the night stick and holder from the opposite side;

FIG. 3 is a view similar to FIG. 2 illustrating a manner of withdrawing the night stick from the holder; and FIG. 4 is a plan view of the sleeve forming a part of the holder as unrolled in a plane.

Referring to the drawing, particularly to FIG. 1, there is illustrated an improved holder for night sticks and the like generally indicated 10 and comprising a sleeve 12 and a loop 14 for securing holder 10 in position depending from a belt 16 worn by a policeman or the like. As noted more particularly hereinafter, sleeve 12 is adapted to retain a night stick, generally indicated 18, in a position depending from the belt 16, the night stick including a tapered body 20, a handle 22, and enlarged diameter flanges 24 and 26 at opposite ends of handle 22. Handle 22 includes a plurality of axially spaced grooves 30 which provide an improved grip for night stick 18.

As illustrated more particularly in FIGS. 3 and 4, sleeve 12 is split lengthwise to form a pair of opposed edges 30 and 32. A pair of snap type fasteners 34 and 36 are provided adjacent the upper and lower ends respectively of sleeve 12 with each fastener having cooperating parts on the opposed edge portions of sleeve 12. Particularly, the upper portion of edge 32 of sleeve 12 includes a tab 38 for overlying the opposed upper portion 40 of edge 30, tab 38 carrying the female part 42 of snap fastener 34. The male part 44 of fastener 34 is carried by the upper portion 40 of edge 30 on a flexible disk 41, preferably leather, stitched to sleeve 12. Also, the upper fastener 34 is oriented on the holder to lie between the holder and the belt 16 thereby locking the fastener therebetween in a position not readily accessible for unsnapping action. The opposed edge portions at the lower end of sleeve 12 comprise tabs 46 and 48, which carry the male and female parts 50 and 52 respectively of lower snap fastener 36. An opening 54 is provided in a central portion of sleeve 12 and a rivet 56 (FIG. 2) pivotably secures the overlapping end portions of loop 14 to sleeve 12, the pivotal axis being disposed intermediate the fasteners 34 and 36.

To retain night stick 18 within sleeve 12 in a position depending therefrom, the body portion of night stick 18 immediately below flange 24 is received within sleeve 12 and snap fasteners 34 and 36 are closed whereby sleeve 12 completely encompasses and confines the stick in the holder. Sleeve 12 is dimensioned such that, when snap fasteners 34 and 36 are closed, the enlarged diameter flange 24 and the enlarged tapered body of the night stick on opposite sides of the sleeve 12 preclude endwise movement of the stick through the holder and, as a consequence, the night stick is fully secured to the holder. In order to remove the night stick from the holder, both fasteners 34 and 36 may be manually unsnapped and the night stick withdrawn through the split sleeve or withdrawn lengthwise in either direction through the sleeve.

To permit quick withdrawal of the night stick from the holder, the handle 22 is grasped and the stick is canted forwardly to move the upper fastener 34 from its normal position between holder 10 and belt 16 to a position providing ready accessibility of the upper fastener to a thumbing action by the user whereby the upper fastener 34 is unsnapped. The stick is then jerked downwardly and forwardly as illustrated in FIG. 3 in a single swinging motion automatically unsnapping lower fastener 36 permitting quick withdrawal of the stick through the split sleeve 12. The particular configuration of fasteners 34 and 36 thus serves the dual purpose of firmly securing the stick in the holder and yet permitting its rapid withdrawal therefrom. Further, while the night stick is fully secured in the holder and obtains an appearance indicating that it cannot readily be withdrawn from the holder, the simple unsnapping action of the upper fastener 34 by the user's thumb and the subsequent swinging of the stick in the holder permits quick withdrawal of the stick from the holder and rapid deployment thereof.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A holder for a night stick having a generally cylindrical handle and an enlarged diameter portion directly below the handle comprising; a sleeve formed of flexible material for receiving the body of the night stick, just below the enlarged diameter portion of the handle, said sleeve being split substantially lengthwise therealong and having generally opposed edge portions, first and second fasteners spaced axially along said sleeve with each fastener having cooperating parts carried by said opposed edge portions for releasably securing the latter one to the other thereby to selectively open and close said sleeve about the body of the stick, said first fastener being adapted to close an upper portion of said sleeve about the body of the night stick and form a sleeve diameter less than the diameter of the enlarged portion of the night stick directly below its handle thereby to substantially constrain the night stick from endwise movement axially through the sleeve in one direction, said second fastener being adapted to close a lower portion of said sleeve about the body of the night stick, said second fastener being releasable in response to an enlargement of the diameter of the lower portion of said sleeve thereby permitting quick release of the night stick from said holder after said first fastener is released, means connected to said sleeve for supporting said holder.

2. The holder according to claim 1 wherein one of said edge portions adjacent the upper portion of said sleeve includes a flap for overlying the other of said edge portions, the cooperating parts of said first fastener being carried by said flap and an underlying portion of said other edge portion.

3. The holder according to claim 2 wherein said first fastener is a snap fastener.

4. The holder according to claim 1 wherein the edge portions adjacent the lower portion of said sleeve extend outwardly from said sleeve to form a pair of outwardly projecting tabs, the inner faces of said tabs facing one another, the cooperating parts of said second fastener being carried by said facing tabs.

5. The holder according to claim 4 wherein said second fastener comprises a quick release snap fastener.

6. The holder according to claim 1 wherein one of said edge portions adjacent the upper portion of said sleeve includes a flap for overlying the other of said edge portions, the cooperating parts of said first fastener being carried by said flap and an underlying portion of said other edge portion, the edge portions adjacent the lower portion of said sleeve extending outwardly from said sleeve to form a pair of outwardly projecting tabs, the inner faces of said tabs facing one another, the cooperating parts of said second fastener being carried by said facing tabs, said first and second fasteners comprising snap type fasteners.

7. The holder according to claim 1 wherein said connecting means includes a belt, means pivotally connecting said sleeve and said belt with the pivotal axis located along said sleeve below said first fastener, said first fastener being disposed between said sleeve and said belt to preclude ready access to said first fastener when the night stick obtains a normal position depending from the belt, said sleeve being pivotal with respect to said belt such that said first fastener obtains a position relative to the belt permitting ready access thereto.

8. A holder for a night stick having a generally cylindrical handle and an enlarged diameter portion directly below the handle comprising; a sleeve formed of flexible material for receiving the body of the night stick, just below the enlarged diameter portion of the handle, said sleeve being split substantially lengthwise therealong and having generally opposed edge portions, one of said edge portions adjacent the upper portion of said sleeves having a flap for overlying the other of said edge portions, first and second fasteners spaced axially along said sleeve with each fastener having cooperating parts carried by said opposed edge portions for releasably securing the latter one to the other thereby to selectively open and close said sleeve about the body of the stick, the cooperating parts of said first fastener being carried by said flap and an underlying portion of said other edge portion, said first fastener being adapted to close an upper portion of said sleeve about the body of the night stick and form a sleeve diameter less than the diameter of the enlarged portion of the night stick directly below its handle thereby to substantially constrain the night stick from endwise movement axially through the sleeve in one direction, said second fastener being adapted to close a lower portion of said sleeve about the body of the night stick, the edge portions adjacent the lower portion of said sleeve extending outwardly from said sleeve to form a pair of outwardly projecting tabs, the inner faces of said tabs facing one another, the cooperating parts of said second fastener being carried by said facing tabs, said first and second fasteners comprising snap type fasteners, said second fastener being releasable in response to an enlargement of the diameter of the lower portion of said sleeve thereby permitting quick release of the night stick from said holder after said first fastener is released, connecting means including a belt connector, means pivotally connecting said sleeve and said belt connector with the pivotal axis located along said sleeve below said first fastener, said first fastener being disposed between said sleeve and said belt connector to preclude ready access to said first fastener when the night stick obtains a normal position depending from the belt connector, said sleeve being pivotal with respect to said belt connector such that said first fastener obtains a position relative to the belt connector permitting ready access thereto.

9. A holder for a night stick having a generally cylindrical handle, a generally cylindrical body portion, and an enlarged diameter portion separating the handle from the body portion comprising; a sleeve formed of flexible material for receiving the body of the night stick, just below the enlarged diameter portion of the handle, said sleeve being split substantially lengthwise therealong and having generally opposed edge portions, one of said edge portions adjacent the upper portion of said sleeve having a flap for overlying the other of said edge portions, first and second fasteners spaced axially along said sleeve with each fastener having cooperating parts carried by said opposed edge portions for releasably securing the latter one to the other thereby to selectively open and close said sleeve about the body of the stick, the cooperating parts of said first fastener being carried by said flap and said other edge portion, said first fastener being adapted to close an upper portion of said sleeve about the body of the night stick and form a sleeve diameter less than the diameter of the enlarged portion of the night stick direcly below its handle thereby to substantially constrain the night stick from endwise movement axially through the sleeve in one direction, said second fastener being adapted to close a lower portion of said sleeve about the body of the night stick, the edge portions adjacent the lower portion of said sleeve extending outwardly from said sleeve to form a pair of outwardly projecting tabs, the inner faces of said tabs facing one another, the cooperating parts of said second fastener being carried by said facing tabs, said second fastener being releasable in response to an enlargement of the diameter of the lower portion of said sleeve thereby permitting quick release of the night stick from said holder after said first fastener is released, and means for connecting said sleeve to a belt, said sleeve being pivotal with respect to said belt connector such that said first fastener obtains a position relative to the belt connector permitting ready access thereto.

10. A holder for a night stick having a handle, a body portion and an enlarged diameter portion directly below the handle comprising; a sleeve formed of flexible material for receiving the body of the night stick, just below the enlarged diameter portion of the handle, said sleeve being split substantially lengthwise therealong and having generally opposed edge portions, one of said edge portions adjacent the upper portion of said sleeve having a flap for overlying the other of said edge portions, first and second fasteners spaced axially along said sleeve with each fastener having cooperating parts carried by said opposed edge portions for releasably securing the latter one to the other thereby to selectively open and close said sleeve about the body of the stick, the cooperating parts of said first fastener being carried by said flap and an underlying portion of said other edge portion, said first fastener being adapted to close an upper portion of said sleeve about the body of the night stick and form a sleeve diameter less than the diameter of the enlarged portion of the night stick directly below its handle thereby to substantially constrain the night stick from endwise movement axially through the sleeve in one direction, said second fastener being adapted to close a lower portion of said sleeve about the body of the night stick, the edge portions adjacent the lower portion of said sleeve extending outwardly from said sleeve to form a pair of outwardly projecting tabs, the inner faces of said tabs facing one another, the cooperating parts of said second fastener being carried by said facing tabs, said second fastener being releasable in response to an enlargement of the diameter of the lower portion of said sleeve thereby permitting quick release of the night stick from said holder after said first fastener is released, connecting means including a belt connector, means pivotally connecting said sleeve and said belt connector with the pivotal axis located along said sleeve below said first fastener, said sleeve being pivotal with respect to said belt connector such that said first fastener obtains a position relative to the belt connector permitting ready access thereto.

* * * * *